US006189311B1

(12) United States Patent
Rakhmailov et al.

(10) Patent No.: US 6,189,311 B1
(45) Date of Patent: Feb. 20, 2001

(54) GAS TURBINE ENGINE

(75) Inventors: Anatoly Rakhmailov, Bataysk (RU); Valentin Yaishnikov; Mikhail Kolotilenko, both of Zaporozhe (UA); Oleg Rakhmailov, Rostov Don; Igor Drozd, Rostov-Don, both of (RU); Martin Kalin, Washington, DC (US)

(73) Assignee: ALM Development, Inc., Washington, DC (US)

( * ) Notice: Under 35 U.S.C. 154(b), the term of this patent shall be extended for 0 days.

(21) Appl. No.: 09/267,895

(22) Filed: Mar. 11, 1999

(51) Int. Cl.[7] ..... F02C 1/06; F02C 6/00
(52) U.S. Cl. ..... 60/39.162; 60/39.15; 60/39.181
(58) Field of Search ..... 60/39.162, 39.161, 60/39.181, 39.15

(56) References Cited

U.S. PATENT DOCUMENTS

| | | | |
|---|---|---|---|
| 1,388,707 | 8/1921 | Heinze . | |
| 1,868,143 | 7/1932 | Heinz . | |
| 2,303,381 | 12/1942 | New . | |
| 2,579,049 | 12/1951 | Price . | |
| 2,784,551 | 3/1957 | Karlby et al. . | |
| 2,821,067 | 1/1958 | Hill . | |
| 2,823,520 | 2/1958 | Spalding . | |
| 3,209,536 | 10/1995 | Howes . | |
| 3,280,555 | 10/1966 | Charpentier et al. . | |
| 3,287,904 | 11/1966 | Warren et al. . | |
| 3,469,396 | 9/1969 | Onishi et al. . | |
| 3,727,401 | 4/1973 | Fincher . | |
| 3,751,911 | 8/1973 | De Tartaglia . | |
| 3,775,974 | 12/1973 | Silver . | |
| 3,826,084 | 7/1974 | Branstrom et al. . | |
| 3,886,732 | 6/1975 | Gamell . | |
| 3,907,457 | 9/1975 | Nakamura et al. . | |
| 3,971,209 | 7/1976 | de Chair . | |
| 4,024,705 | 5/1977 | Hedrick . | |
| 4,084,922 | 4/1978 | Glenn . | |
| 4,118,927 | 9/1978 | Kronogard . | |
| 4,142,836 | 3/1979 | Glenn . | |
| 4,213,297 * | 7/1980 | Forster et al. | 60/39.51 R |
| 4,277,938 | 7/1981 | Belke et al. . | |
| 4,338,780 | 7/1982 | Sakamoto et al. . | |
| 4,338,781 | 7/1982 | Belke et al. . | |
| 4,501,053 | 2/1985 | Craig et al. . | |
| 4,549,402 | 10/1985 | Saintsbury et al. . | |
| 4,817,858 | 4/1989 | Verpoort . | |
| 4,991,391 | 2/1991 | Kosinski . | |
| 5,054,279 | 10/1991 | Hines . | |
| 5,123,242 * | 6/1992 | Miller | 60/226.1 |
| 5,201,796 * | 4/1993 | Glinski et al. | 60/39.161 |
| 5,269,133 * | 12/1993 | Wallace | 60/204 |
| 5,473,881 | 12/1995 | Kramnik et al. . | |
| 5,497,615 | 3/1996 | Noel . | |

FOREIGN PATENT DOCUMENTS

| | | |
|---|---|---|
| 2332698 | 1/1974 | (DE) . |
| 2335594 | 8/1974 | (DE) . |
| 2437990 | 2/1976 | (DE) . |
| 2018641 | 10/1991 | (DE) . |
| 103370 | 3/1984 | (EP) . |
| 77 09399 | 10/1978 | (FR) . |
| 196452 | 4/1923 | (GB) . |
| 580447 | 9/1946 | (GB) . |
| 753652 | 7/1956 | (GB) . |
| 801281 | 9/1958 | (GB) . |
| 803994 | 11/1958 | (GB) . |
| 1170793 | 11/1969 | (GB) . |
| 1435687 | 5/1976 | (GB) . |
| 4863 506/06 | 6/1992 | (RU) . |

* cited by examiner

*Primary Examiner*—Timothy S. Thorpe
*Assistant Examiner*—Michael K. Gray
(74) *Attorney, Agent, or Firm*—Hughes Hubbard & Reed LLP; Ronald Abramson; Peter Sullivan

(57) ABSTRACT

In a gas turbine engine in which bearings (18, 30) of turbine (12) and compressor turbine (22) and exhaust duct (32) of compressor turbine (22) are attached to external annular wall (46) of heat exchanger (44). External annular wall (46) of heat exchanger (44) has heat insulation layer (48) on the inside surface. The engine has cooling device (94) for cooling external annular wall (46) of heat exchanger (44) on the side opposite to heat insulating layer (48).

27 Claims, 3 Drawing Sheets

GAS TURBINE ENGINE

The invention relates to the field of gas turbine engines, and more specifically, to a counter-rotating gas turbine having a heat exchanger in the turbine flow duct.

BACKGROUND OF THE INVENTION

This invention concerns counter-rotating gas turbines having a heat exchanger in the turbine flow duct. It is widely known to use heat exchangers (recuperators) in the flow duct of gas turbine engines (Paul Graig, in Electric and Hybrid Vehicle Design Studies, SP 1243, Society of Automotive Engineers, Inc., 1997, Warrendale, Pa., p. 135). The heat exchangers are used to increase efficiency by recycling waste heat. Normally, the heat exchanger is mounted outside the gas turbine engine and is connected to it by means of piping, or, as is the case with the above reference, the heat exchanger encloses the gas turbine engine and has an outer annular casing wall that can be heat insulated on the outside to lower heat losses to the ambient environment. Normally, the gas turbine engine has a separate frame that supports the turbine stator, the combustor and the shaft bearings. The outer annular wall or casing of the heat exchanger is supported by the frame and is hot during operation.

It is also known to use counter-rotating gas turbine engines (see our pending application Ser. No. 09/161,170, filed Sep. 25, 1998) in which a turbine and a compressor turbine rotate on different shafts in opposite directions, and shafts are journalled in bearings. The gas turbine engine has a heat exchanger that is used to heat the fluid coming from the compressor to the combustor and to the turbine. It should be noted that in the gas turbine engine of this type, there is no stator with guide vanes, and the compressor turbine is mounted immediately downstream of the turbine, and the turbine functions as a rotating guide vane system for the compressor turbine. This means that the fluid from the turbine flows directly to the blades of the compressor turbine. Therefore, the flow duct between the two turbines must have a stable geometry to minimize losses. This means that the clearance between the two turbines and the position of their shafts in space (alignment) should be maintained as accurate as possible under any operating conditions (speed, power, and temperature). Any deviation from the accurate geometry between the two turbines will result in a decrease in efficiency.

SUMMARY OF THE INVENTION

It is an object of the invention to provide a counter-rotating gas turbine engine of the above-described type in which the general layout of the gas turbine engine assures high efficiency under all operating conditions.

Another object of the invention is to provide a counter-rotating gas turbine engine of the above-described type, which has a streamlined design and a low cost of manufacture.

The foregoing objects are accomplished through the design of a gas turbine engine in which the bearings of the turbine and compressor turbine and the exhaust duct of the compressor turbine are attached to the external annular wall of a heat exchanger. The external annular wall of the heat exchanger has a heat insulation layer on the inside surface.

DETAILED DESCRIPTION OF THE DRAWINGS

Figure 1:
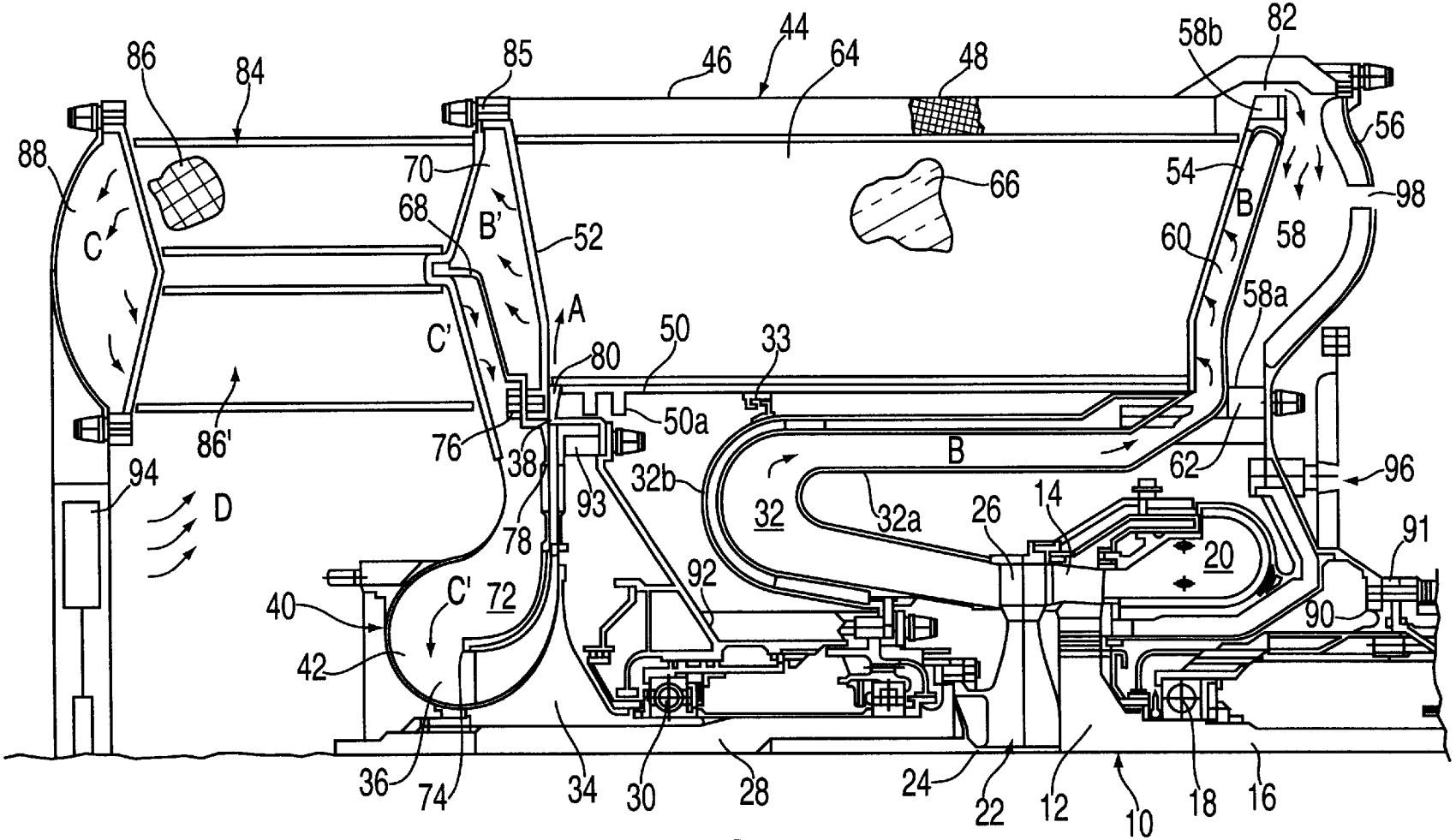
FIG. 1 is a schematic view in longitudinal section of a counter-rotating gas turbine engine according to the invention.

In FIG. 1, a counter-rotating gas turbine engine has a turbine 10 that has a rotor disk 12 with blades 14. The turbine rotor disk is mounted on a shaft 16 journalled in bearings 18. A combustor 20 is mounted immediately upstream of blades 14 of turbine 10 to supply heated fluid to the turbine. A compressor turbine 22 has a rotor disk 24 with blades 26. Rotor disk 24 of the compressor turbine is mounted on a shaft 28 journalled in bearings 30. Turbines 10 and 22 are mounted on different shafts, and shafts 16 and 28 of the two turbines rotate in opposite directions. As can be seen in FIG. 1, fluid will flow directly from blades 14 to blades 26, i.e., without any guide vanes between them. A preset clearance is established between rotor disks 12 and 24 of turbines 10 and 22, and their shafts 16 and 28 are aligned. An exhaust duct 32 for compressor turbine 22 removes fluid from both turbines. A compressor 34 rotates together with compressor turbine 22. More specifically, compressor 34 is mounted on shaft 28 of rotor disk 24 of the compressor turbine. Compressor 34 has an inlet 36 and an outlet 38. Compressor 34 compresses fluid in the turbine flow duct. Compressor 34 has an inlet duct 40 that defines an inlet space 42.

Heat exchanger 44 has an external annular wall 46 with a heat insulating layer 48, an internal annular wall 50, a first end wall 52, and a second end wall 54. Heat insulating layer 48 is attached to external annular wall 46 on the inner side. First end wall 52 is located adjacent to compressor 34, whereas second end wall 54 is located adjacent to combustor 20. First end wall 52 is fastened to external annular wall 46 and internal annular wall 50. The heat exchanger has an end cover 56 that is used as the end cover for the entire engine. End cover 56 is rigidly attached to external annular wall 46 by any appropriate known means. A membrane 58, which has an inner periphery **58*a* and an outer periphery 58*b*, has its outer periphery 58*b* attached to second end wall 54. Membrane 58 defines with second end wall 54 an annular space 60 that communicates with exhaust duct 32. Inner periphery 58*a* of membrane 58 is secured to end cover 56 at point 62. Exhaust duct 32 has its inner run 32*a* that is attached to end cover 56 at the same point 62. An outer run 32*b* of exhaust duct 32 is attached at point 33 to internal annular wall 50. This attachment method allows for a certain degree of movement between outer run 32*b* and internal annular wall 50 of the heat exchanger, especially if internal annular wall 50 has a compensation portion as shown at 50*a***.

Annular walls 46 and 50 and end walls 52 and 54 define an interior heat exchange space 64 of heat exchanger 44. Heat exchange members such as panels 66 are provided within heat exchange interior space 64 of heat exchanger 44 and are rigidly secured to end walls 52 and 54. These panels may be formed by pairs of plates defining an interior space (not shown).

Inlet space 42 of compressor 34 is divided by a partition 68 into a first chamber 70 and a second chamber 72. A cover 74 of compressor is in second chamber 72. Compressor 34 is connected to first end wall 52 at a point 76. Inlet duct 40 of compressor 34 is attached to first end wall 52 though partition 68 at a point 76 at a baffle 78 of compressor 34.

Outlet 38 of compressor 34 communicates with interior heat exchange space 64 of heat exchanger 44 through an annular slit 80, with the fluid going from compressor 34 as shown by arrow A. The interior heat exchange space 64 of heat exchanger 44 communicates with combustor 20 and turbine 10 through an annular space 82 defined between membrane 58 and end cover 56, the fluid flowing as shown by arrow A'. The interior spaces of heat exchange members 66 communicate with annular space 60, whereby fluid from compressor turbine enters into the interior spaces of the heat exchange members as shown by arrow B. The opposite ends of heat exchange members 66 terminate in first chamber 70 of inlet space 42, and fluid flows here as shown by arrows B'.

A cooler generally shown at 84 is attached to first end wall 52 (and to external annular wall 46) at point 85. The cooler has cooling members 86 and a space 88. Cooling members, which can be constructed of panels consisting of a pair of plates defining a space between them, communicate with first chamber 70 to receive the fluid flow shown by arrow B'. This fluid moves through space 88 and proceeds as shown by arrow C through other cooling members 86' into second chamber 72 as shown by arrow C' to inlet 36 of compressor 34. As fluid moves as shown by arrow C', it cools compressor cover 74. This is necessary to lower the radial temperature gradient of the compressor components. In addition, the thermal energy of the boundary layer within the compressor flow duct is taken off, which allows the temperature of the boundary layer to be reduced, thus lowering the friction losses at the boundary layer.

Bearings 18 on the turbine side are attached to external annular wall 46 through end cover 56 by means of a bearing casing 90 at a point 91. Bearings 30 on the compressor side are attached to first end wall 52 by means of a bearing casing 92 at a point 93.

It will be understood that during operation, the exhaust fluid from exhaust passage 32 flows through heat exchange members 66 and is cooled down with the flow of fluid that flows from outlet 38 of compressor 34 through interior heat exchange space 64 of heat exchanger 44. The fluid that goes to inlet 36 of compressor 34 is cooled in cooling members 86, 86" of cooler 84, by means of a fan 94. As a result of its operation, the external annular wall of heat exchanger 44 receives a certain amount of heat that is reduced by thermal resistance of insulating layer 48. The heat is removed from the outer surface of external annular wall 46 by means of fan 94, air flow (in a moving vehicle), or by any other known means located outside heat exchanger 44. The flow from this cooling means is shown by arrow D. As insulating layer 48 is inside the external annular wall, this wall is relatively cold, and all the components of the engine that are attached to external annular wall 46 will not experience temperature-induced displacements that might otherwise result in changes in the geometry between turbines 10 and 22.

Figure 2:
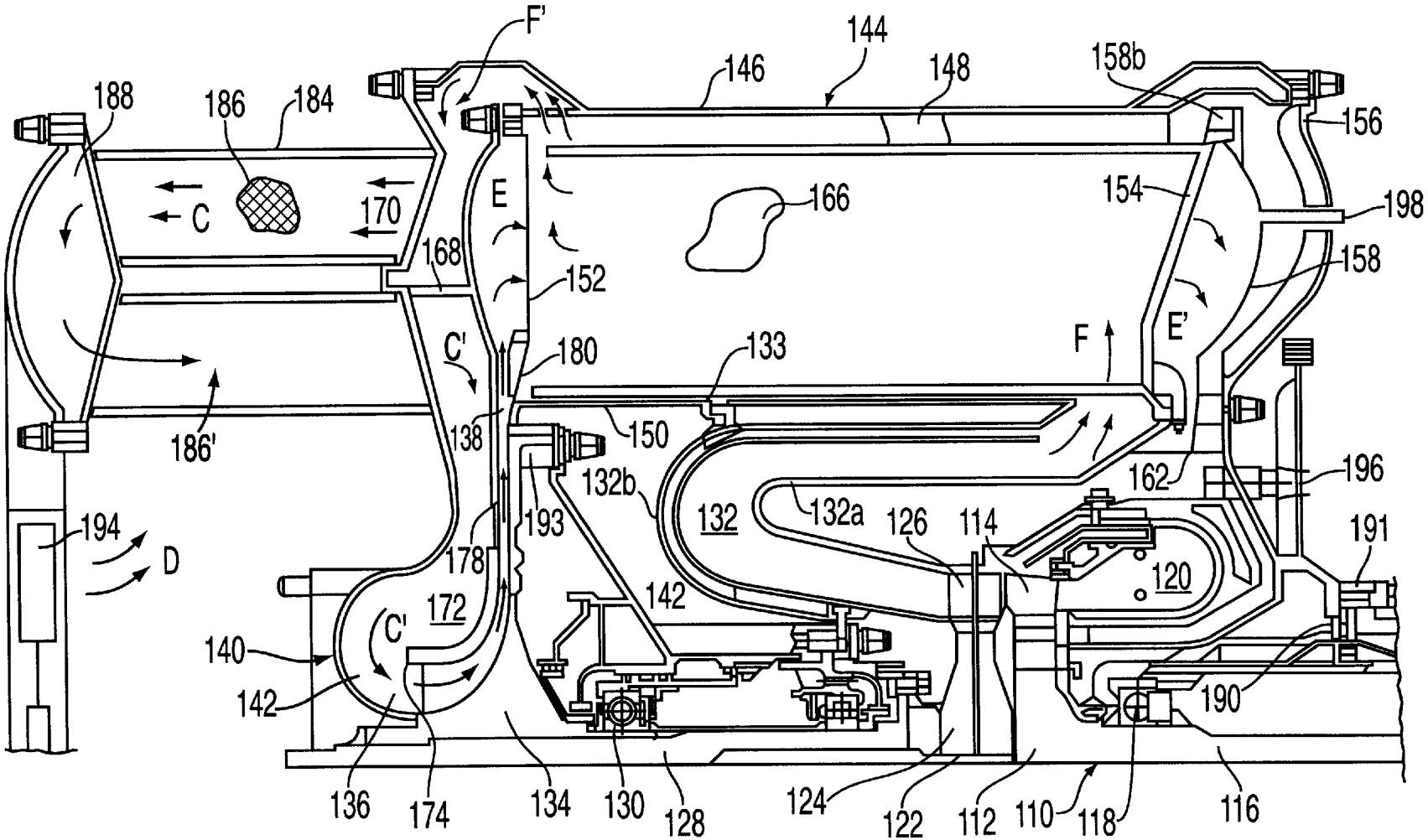
FIG. 2 is a schematic view similar to that shown in FIG. 1, which illustrates another embodiment of the gas turbine engine according to the invention.

The embodiment shown in FIG. 2, where similar parts are shown at the same reference numeral with addition of 100, differs from the embodiment of FIG. 1 by the fact that fluid in the engine flow duct has higher density (pressure). This would result in a greater load on the walls of heat exchanger 144. For this reason, the fluid flow that goes from compressor 134 to turbine 110 and combustor 120 is channeled through heat exchange members 166 as shown by arrows E and E', rather than through interior heat exchange space 164 of heat exchanger 144. The fluid flow from exhaust duct 132 passes through interior heat exchange space 164, as shown by arrows F and F', to cooler 184. For the rest, this embodiment is constructed and functions along the same lines as the embodiment shown in FIG. 1.

It is understood that in both embodiments described above, additional air needed for combustion is supplied to combustor 20, e.g., through a connection 96 (FIG. 1). It is also understood, that fuel is supplied to combustor 20 (not shown) to sustain combustion. The devices and systems for feeding air and fuel and for preparing a fuel and air mixture are not described herein as they do not have material bearing on this invention. A connection 98 having a system for removing excessive fluid from the engine flow duct is also provided to control the engine. This feature also does not have material bearing on this invention.

Figure 3:
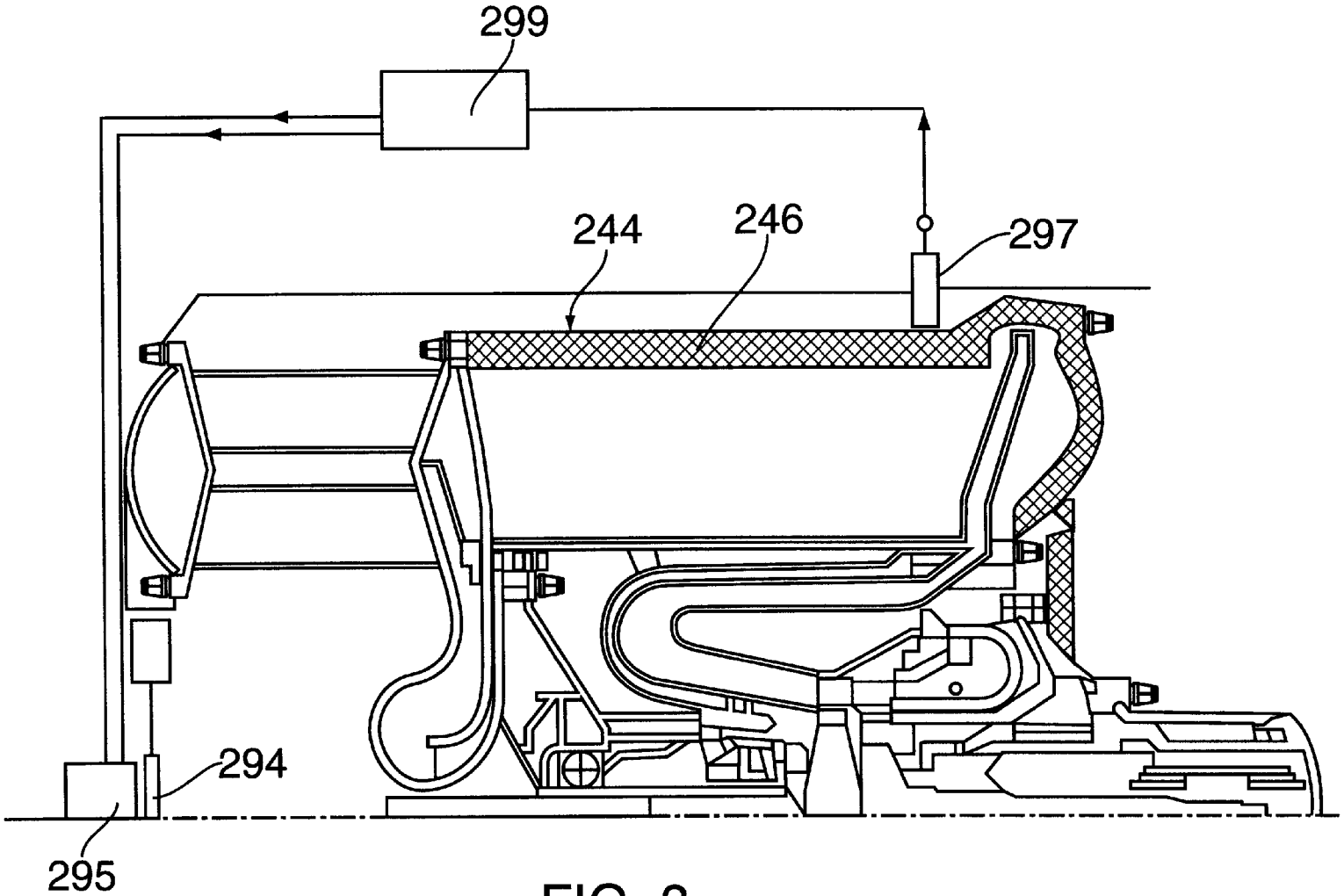
FIG. 3 is an embodiment of the gas turbine engine according to the invention, illustrating a temperature control system.

It will be understood from the above disclosure that the method of supporting all the components of the engine by the external annular wall of the heat exchanger, which is relatively cold, assures a certain degree of stability of clearances and geometry of the turbines. In order to control the geometry, the engine has a cooling fan 294 with a drive 295 (FIG. 3). A temperature pickup device such as a thermocouple 297 is installed in external annular wall 246 of heat exchanger 244. Thermocouple 297 is connected to a controller 299 that is electrically connected to drive 295 of fan 294. It will be understood that controller 299 can be made as any device that can control speed of drive 295 according to a signal from thermocouple 297. It can be a simple power amplifier that supplies power to drive 295, with the gain of the power amplifier being controlled by thermocouple 297. A commercially available programmable controller built around a microprocessor can also be used. It will be understood that providing this cooling control system assures a stable temperature of external annular wall 246 and stable geometry of turbines.

The invention was described with reference to the preferred embodiments. Various changes and modifications can be made, however, without going beyond the spirit and scope of the invention as defined in the attached claims.

We claim:

1. A counter-rotating gas turbine engine, said counter-rotating gas turbine engine comprising:

turbine;

a compressor turbine;

said turbine and said compressor turbine being mounted for rotation in opposite direction;

at least two different shafts for said turbine and said compressor turbine;

a plurality of bearings, each of said at lest two different shafts being journalled in respective bearings of said plurality of bearings;

a compressor mounted for rotation together with said compressor turbine;

an exhaust duct of said compressor turbine;

a combustor mounted immediate upstream of said turbine;

a heat exchanger having a casing that comprises an external annular wall, an internal annular wall, a first end wall adjacent to said compressor, a second end wall adjacent to said combustor, said external annular wall, said internal annular wall, and said first and second end wall defining an interior heat exchange space of said heat exchanger;

a heat insulating layer of said heat exchanger, said heat insulting layer being located interior and adjacent to said external annular wall;

said bearings, said combustor and said exhaust duct being attached to said external annular wall of said heat exchanger.

2. The counter-rotating turbine engine of claim 1, further comprising a cooling means for cooling said external annular wall, said cooling means being located external to said heat exchanger.

3. The counter-rotating turbine engine of claim 2, further comprising a means for controlling said cooling means.

4. The counter-rotating turbine engine of claim 1, further comprising an end cover, said end cover being installed on said turbine and attached to the exterior of said external annular wall of said heat exchanger, said first end wall being fastened to said external annular wall and said second end wall comprising a membrane that has an outer periphery that is movable with respect to said external annular wall and an inner periphery that is attached to said end cover.

5. The counter-rotating turbine engine of claim 4, further comprising a cooling means for cooling said external annular wall, said cooling means being located external to said heat exchanger.

6. The counter-rotating turbine engine of claim 5, further comprising a means for controlling said cooling means.

7. The counter-rotating turbine engine of claim 4, wherein said compressor and said respective bearings of said plurality of bearings, which are located adjacent to said compressor, being secured to said first end wall, said exhaust duct, said combustor and said respective bearings of said plurality of bearings, which are located adjacent to said turbine, being secured to said end cover.

8. The counter-rotating turbine engine of claim 7, further comprising a cooling means for cooling said external annular wall, said cooling means being located external to said heat exchanger.

9. The counter-rotating turbine engine of claim 8, further comprising a means for controlling said cooling means.

10. A counter-rotating gas turbine engine, said counter-rotating gas turbine engine comprising:

a turbine;

a compressor turbine;

said turbine and said compressor turbine being mounted for rotation in opposite directions;

at least two different shafts for said turbine and said compressor turbine;

a plurality of bearings, each of said at least two different shafts being journalled in respective bearings of said plurality of bearings;

a compressor mounted for rotation together with said compressor turbine, said compressor having an inlet and an outlet;

an exhaust duct of said compressor turbine;

a combustor mounted immediately upstream of said turbine;

a heat exchanger having a casing that comprises an external annular wall, an internal annular wall, a first end wall adjacent to said compressor, a second end wall adjacent to said combustor, said external annular wall, said internal annular wall, and said first and second end walls defining an interior heat exchange space of said heat exchanger;

said interior heat exchange space communicating with said turbine and with said outlet of said compressor;

a heat insulating layer of said interior heat exchange space;

a heat insulating layer of said heat exchanger, said heat insulating layer being located interior and adjacent to said external annular wall;

an inlet duct of said compressor, said inlet duct of said compressor being attached to said first end wall and defining an interior duct space;

a cooler, said cooler being attached to said first end wall and having cooling members;

a partition within said inlet space of said compressor, said partition dividing said inlet space into a first chamber that communicates with said exhaust duct through said heat exchange members of said heat exchanger and with said cooling members and a second chamber that communicates with said cooling members and with said compressor inlet;

said bearings, said combustor and said exhaust duct being attached to said external annular wall of said heat exchanger.

11. The counter-rotating turbine engine of claim 10, further comprising a cooling means for cooling said external annular wall, said cooling means being located external to said heat exchanger.

12. The counter-rotating turbine engine of claim 11, further comprising a means for controlling said cooling means.

13. The counter-rotating turbine engine of claim 10, comprising an end cover, said end cover being installed on said turbine and attached to the exterior of said external annular wall of said heat exchanger, said first end wall being fastened to said external annular wall and said second end wall comprising a membrane that has an outer periphery that is movable with respect to said external annular wall and an inner periphery that is attached to said end cover.

14. The counter-rotating turbine engine of claim 13, further comprising a cooling means for cooling said external annular wall, said cooling means being located external to said heat exchanger.

15. The counter-rotating turbine engine of claim 14, further comprising a means for controlling said cooling means.

16. The counter-rotating turbine engine of claim 13, wherein said compressor and said respective bearings of said plurality of bearings, which are located adjacent to said compressor, being secured to said first end wall, said exhaust duct, said combustor and said respective bearings of said plurality of bearings, which are located adjacent to said turbine, being secured to said end cover.

17. The counter-rotating turbine engine of claim 16, further comprising a cooling means for cooling said external annular wall, said cooling means being located external to said heat exchanger.

18. The counter-rotating turbine engine of claim 17, further comprising a means for controlling said cooling means.

19. A counter-rotating gas turbine engine, said counter-rotating gas turbine engine comprising:

a turbine;

a compressor turbine;

said turbine and said compressor turbine being mounted for rotation in opposite directions;

at least two different shafts for said turbine and said compressor turbine;

a plurality of bearings, each of said at least two different shafts being journalled in respective bearings of said plurality of bearings;

a compressor mounted for rotation together with said compressor turbine, said compressor having an inlet and an outlet;

an exhaust duct of said compressor turbine;

a combustor mounted immediately upstream of said turbine;

a heat exchanger having a casing that comprises an external annular wall, an internal annular wall, a first end wall adjacent to said compressor, a second end wall adjacent to said combustor, said external annular wall, internal annular wall, and said first and second end wall defining an interior heat exchange space of said heat exchanger;

heat exchange members in said interior heat exchange space;

said outlet of said compressor communicating with said turbine through said heat exchange members;

a heat insulating layer of said heat exchanger, said heat insulting layer being located interior and adjacent to said external annular wall;

an inlet duct of said compressor, said inlet duct of said compressor being attached to said first end wall and defining an interior duct space;

a partition within said inlet space of said compressor, said partition dividing said inlet space into a first chamber that communicates with said exhaust duct through said interior heat exchange space of said heat exchanger and with said cooling members and a second chamber that communicates with said cooling members and with said compressor inlet;

a cooling means for cooling said external annular wall on the side opposite to said heat insulating layer.

20. The counter-rotating turbine engine of claim 19, further comprising a cooling means for cooling said external annular wall, said cooling means being located external to said heat exchanger.

21. The counter-rotating turbine engine of claim 20, further comprising a means for controlling said cooling means.

22. The counter-rotating turbine engine of claim 10, comprising an end cover, said end cover being installed on said turbine and attached to the exterior of said external annular wall of said heat exchanger, said first end wall being fastened to said external annular wall and said second end wall comprising a membrane that has an outer periphery that is movable with respect to said external annular wall and an inner periphery that is attached to said end cover.

23. The counter-rotating turbine engine of claim 22, further comprising a cooling means for cooling said external annular wall, said cooling means being located external to said heat exchanger.

24. The counter-rotating turbine engine of claim 23, comprising a means for controlling said cooling means.

25. The counter-rotating turbine engine of claim 22, wherein said compressor and said respective bearings of said plurality of bearings, which are located adjacent to said compressor, being secured to said first end wall, said combustor and said respective bearings of said plurality of bearings, which are located adjacent to said turbine, being secured to said end cover and said exhaust duct being attached to said outer periphery of said membrane through said first end wall.

26. The counter-rotating turbine engine of claim 25, further comprising a cooling means for cooling said external annular wall, said cooling means being located external to said heat exchanger.

27. The counter-rotating turbine engine of claim 26, further comprising a means for controlling said cooling means.

* * * * *